United States Patent [19]

Coy

[11] Patent Number: 4,638,888

[45] Date of Patent: Jan. 27, 1987

[54] HYDRAULIC ELEVATOR

[75] Inventor: Jeffrey A. Coy, Lincoln, Nebr.

[73] Assignee: Brownie Manufacturing Co., Inc., Waverly, Nebr.

[21] Appl. No.: 712,766

[22] Filed: Mar. 18, 1985

[51] Int. Cl.[4] ..... B66B 1/04; B66B 5/16

[52] U.S. Cl. ..... 187/19; 187/17; 187/28; 187/69; 187/73; 303/10; 91/42; 91/44

[58] Field of Search ..... 187/17, 19, 68, 69, 187/73, 80, 28, 95, 20, 29 A, 29 B, 29 C, 89; 303/10, 6 M; 188/170; 91/42, 44

[56] References Cited

U.S. PATENT DOCUMENTS

| | | | |
|---|---|---|---|
| 1,050,949 | 1/1913 | Jones | 187/69 |
| 2,407,694 | 9/1946 | Vickers | 187/28 |
| 3,120,880 | 2/1964 | Joseph | 187/17 |
| 3,601,235 | 8/1971 | Huf | 187/17 X |
| 3,830,338 | 8/1974 | Svensson | 187/19 X |
| 3,892,292 | 7/1975 | Takenoshita et al. | 187/68 X |
| 3,942,607 | 3/1976 | Sobat | 187/69 X |
| 3,999,075 | 12/1976 | Johnson et al. | 188/170 X |
| 4,256,350 | 3/1981 | Hoefer | 188/170 X |
| 4,533,021 | 8/1985 | Perez de la Orden | 187/20 X |

*Primary Examiner*—H. Grant Skaggs
*Assistant Examiner*—Nils Pedersen
*Attorney, Agent, or Firm*—Allegretti, Newitt, Witcoff & McAndrews, Ltd.

[57] ABSTRACT

A non-public hydraulic elevator has three emergency systems isolated from the primary drive system: a control system, a manually activated emergency descent system, and an emergency stop system. A hydraulic brake is provided a primary and emergency brake release pressure supply by the control and manually activated emergency descent systems, respectively. The emergency stop system overrides the control system and the emergency descent system to positionally lock the elevator car. A hydraulic safety-governor system operates during descent to monitor and maintain a controlled descent speed.

11 Claims, 2 Drawing Figures

RESERVOIR

HYDRAULIC ELEVATOR

BACKGROUND OF THE INVENTION

The present invention relates generally to an elevator system and more particularly to a non-public hydraulic elevator having emergency systems which are isolated and independent from the primary drive system.

Numerous types of elevator systems are presently available for non-public usage. (For purposes hereof, the term "non-public" refers to an elevator system other than those designed for direct usage by the public. Examples include an elevator system temporarily erected at a construction site, an elevator system for a missile silo, and an elevator system for servicing for pollution-control chimney.) These systems range in complexity from a simple chain-drawn operation to a hydrostatic operation.

SUMMARY OF THE INVENTION

In a first principal aspect, the present invention is a low-cost, readily maintainable hydraulic elevator. Significantly, the present invention includes three safety, emergency systems, i.e., a control system, a manually-activated emergency descent system, and an emergency stop system, which are independent and isolated from the primary drive system. This independence and isolation substantially enhance the operating and safety characteristics of the present invention.

More particularly, the hydraulic elevator includes an elevator car and a primary drive system mounted upon a drive guide track. The elevator car is driven by a primary hydraulic motor which receives a regulated hydraulic flow from a primary hydraulic control. Regulation of the hydraulic flow controls the direction and speed of the elevator car.

The hydraulic elevator further includes a brake system, i.e., a hydraulic brake interconnected to the drive guide track through a brake gear. The control and manually-activated emergency descent systems provide a primary and emergency release pressure supply, respectively, received by the brake system under predetermined conditions. The hydraulic brake, in response, locks and releases the brake gear (and thus the elevator car) with respect to the drive guide track.

The control system monitors the regulated hydraulic flow and provides the primary release pressure supply under predetermined conditions within the primary hydraulic control. The emergency descent system is activated from within the elevator cage.

The emergency stop system provides for the immediate positional locking of the elevator car. The emergency stop system overrides the control system and manually-activated emergency descent subsystem.

The hydraulic elevator of the present invention further includes a hydraulic safety-governor system mechanically coupled to the brake system. The hydraulic safety-governor system is operative during descent of the elevator car to monitor and, if necessary, to maintain a predetermined, controlled descent speed.

In a second principal aspect, the present invention includes a cost-saving means of interconnecting the control and manually-activated emergency descent systems to the brake system. The interconnection is achieved by a priority valve, having multiple operating states, in fluid communication with the control and descent systems. The priority valve maintains operational independence and isolation between these systems while enabling the systems to "share" structural hydraulic lines and connections resulting in substantially reduced production and maintenance costs.

In a third principal aspect, the present invention is a hydraulic safety-governor system. This safety-governor system may be used with non-hydraulically driven elevators to provide a safe, independent control of descent.

The safety-governor system defines a hydraulic circuit mechanically coupled to the guide rail mast of the elevator. More particularly, the hydraulic circuit includes a hydraulic brake linked to the guide rail mast. A hydraulic pump is connected to the rotatable shaft of the hydraulic brake and responsively provides a descent hydraulic flow, within the hydraulic circuit.

The safety-governor system further includes a descent control mechanism for continuously monitoring the descent hydraulic flow. The descent control mechanism restricts or limits the descent hydraulic flow to a predetermined flow rate and thereby controls the descent speed of the elevator car.

It is thus an object of the present invention to provide a safe, low-cost, readily maintainable hydraulic elevator. Another object is a hydraulic elevator having operationally separate and isolated safety controls. Still another object is a hydraulic elevator having an independent, hydraulic manually-operated emergency descent system.

It is also an object of the present invention to provide a hydraulic elevator operable in a wide range of environments and conditions. Yet another object is a hydraulic elevator wherein independent, isolated systems share connections so as to reduce the overall complexity of the elevator and thus production and maintenance costs. It is yet another object to provide a safe, independent hydraulic safety-governor system for moitoring and controlling the descent speed of the elevator.

These and other features, objects and advantages are described or implicit in the following detailed description.

BRIEF DESCRIPTION OF THE DRAWINGS

A preferred embodiment of the present invention is described, in detail, with reference to the drawing wherein.

DETAILED DESCRIPTION OF A PREFERRED EMBODIMENT

Figure 1:
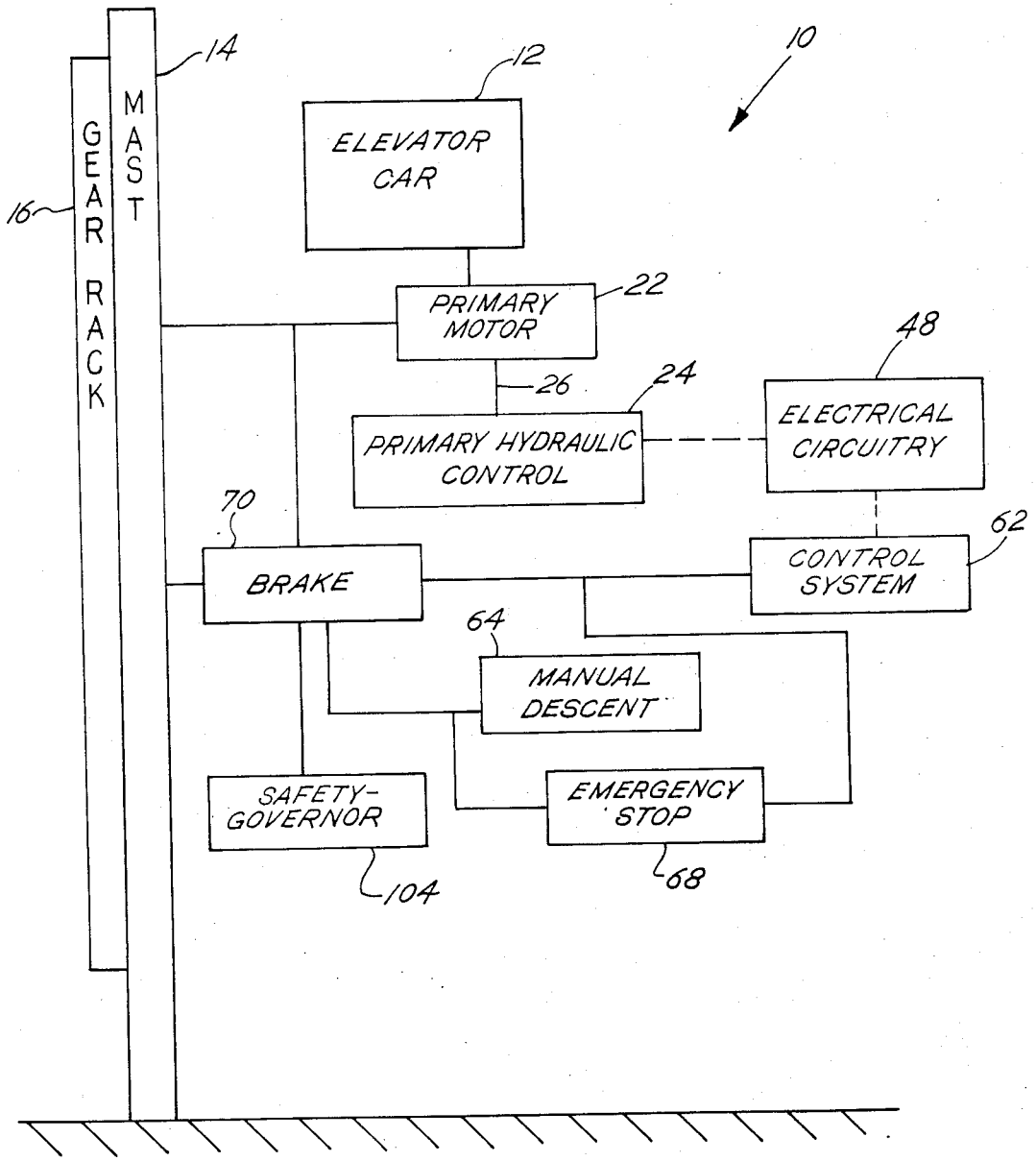
FIG. 1 is a simplified schematic diagram of the hydraulic elevator.
Figure 2:
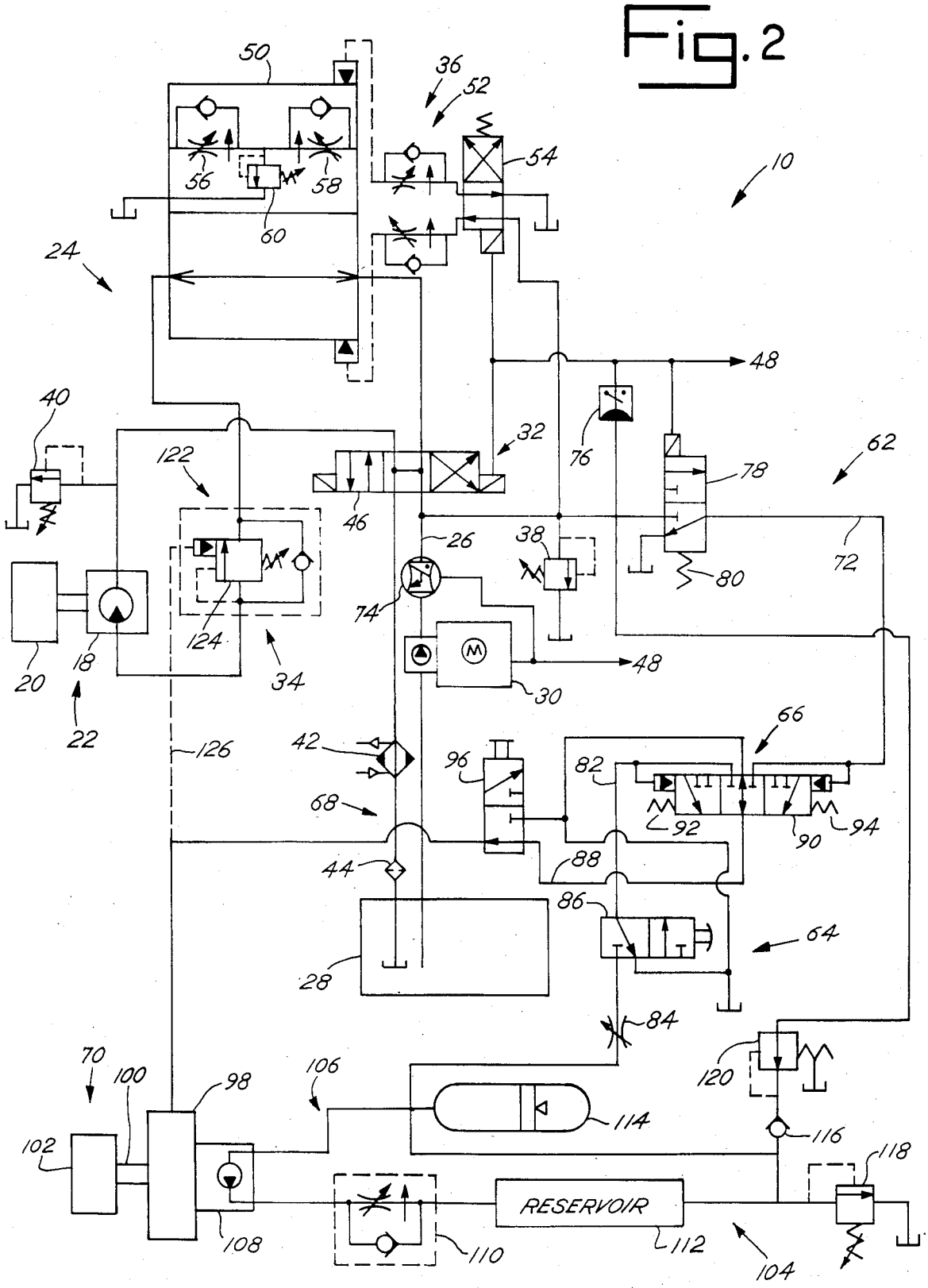
FIG. 2 is a detailed hydraulic, partial electrical schematic diagram of the hydraulic elevator shown in FIG. 1.

A preferred embodiment of the present invention is shown in FIGS. 1 and 2 as a non-public hydraulic elevator 10, including an elevator car 12 driven along a guide rail mast 14. The guide rail mast 14 includes a gear rack 16. As shown, the elevator 10 further includes a hydraulic motor 18, secured to the elevator car 12, and drive gear means 20 for drivingly interconnecting the gear rack 16 and hydraulic motor 18. The motor 18 and drive gear means 20 define, in cooperation, primary motor means, generally designated 22, for bidirectionally driving the elevator car 12.

The primary motor means 22 is connected to primary hydraulic control means, generally designated 24, for providing a regulated hydraulic flow to the hydraulic motor 18. The primary motor means 22 and primary hydraulic control means 24 define the primary drive system of the hydraulic elevator 10. The regulated hydraulic flow has a direction and rate, such that the direction and speed of the hydraulic motor 18 are controlled. The regulated hydraulic flow is delivered through a hydraulic line 26 under a line pressure.

As shown in FIG. 2, the primary hydraulic control means 24 includes a temperature-controlled reservoir 28, a hydraulic pump 30, directional control means 32, flow control means 34, rate control means 36, pressure relief valves 38, 40, a fluid cooler 42, and a filter 44, interconnected as shown. The pump 30, preferably driven by a 15 horsepower electric motor, pumps hydraulic fluid from the reservoir 28 at a preferred rate of 10.5 gallons per minute (GPM). The maximum line pressure, preferably 3,000 pounds per square inch (PSI), is controlled by the pressure relief valve 38. When the line pressure exceeds this threshold, hydraulic fluid is diverted by the relief valve 38 for return to the reservoir 28.

The directional control means 32 controls the direction of the regulated hydraulic flow. In this preferred embodiment, the directional control means 32 includes an electric solenoid directional valve 46 which defines an "up" circuit and a "down" circuit in response to manually-operated buttons (not shown) within the elevator car 12, operative through the electrical circuitry 48 of the hydraulic elevator 10. On the "down" path, hydraulic flow is to the hydraulic motor 18, through the flow control means 34, and then to the rate control means 36; in the "up" path, the flow is opposite.

The rate control means 36 sets the rate of the regulated hydraulic flow received by the primary motor means 22. The rate control means 36 defines a "high speed" circuit and a "low speed" circuit, preferably representing flow rates of 10.5 GPM and 4.0 GPM, respectively.

Referring to FIG. 2, the rate control means 36 includes a flow diverting valve 50, a pressure compensated flow control valve arrangement 52, and a control valve 54, interconnected as shown. The flow diverting valve 50 defines an unrestricted passage therethrough, corresponding to the "high speed" circuit, and a restricted passage, corresponding to the "low speed" circuit. Within the "low speed" circuit, the flow diverting valve 50 includes two oppositely-oriented flow reducing valves 56, 58 and an interposed relief valve 60. The two flow control valves 56, 58 operate to reduce the flow generated by the hydraulic pump 30 from 10.5 GPM to 4.0 GPM, irrespective of flow direction. The relief valves 40, 60 substantially dissipate any pressure spike caused by deceleration of the elevator car 12 and thereby substantially avoid damage to the seals (not shown) of the hydraulic components.

The control valve 54 controls the operational position of the flow diverting valve 50 and thus controls the operative circuit. In this preferred embodiment, the "high speed" circuit produces a cage speed of 150 feet per minute (FPM) and "low speed" is 60 FPM.

The control valve 54 is an electrical solenoid valve spring-biased to provide high speed operation. The control valve 54 is activated (shifting the flow diverting valve 50 into the "low speed" circuit) by means of a cam (not shown) in the hoistway 14. Cams are located a predetermined distance above and below each floor or landing. As the elevator car 12 approaches a selected floor, the electrical circuitry 48 of the hydraulic elevator system 10 responds to the cam and activates the control valve 54, thereby decelerating the elevator car 12.

The pressure compensated flow control valve arrangement 52, interposing the flow diverting valve 50 and the control valve 54, controls the shifting speed of the flow diverting valve 50. This control provides a smooth engagement or transfer between "low speed" and "high speed" operation of the hydraulic elevator 10.

The hydraulic elevator 10 further includes control means 62, manually-activated emergency descent means 64, priority valve means 66, emergency stop means 68, and brake means 70. The control means 62 communicates with the primary hydraulic control means 24 and monitors the regulated hydraulic flow and pressure. Under predetermined conditions within the primary hydraulic control means 24, the control means 62 provides a primary brake release pressure supply in line 72.

In this preferred embodiment, control means 62 includes a flow meter 74, a pressure switch 76, and an electrical solenoid sensor-responsive valve 78, interconnected as shown. The flow meter 74 provides an electric flow signal whenever the rate of the regulated hydraulic flow exceeds a predetermined, minimum rate threshold, preferably 9.0 GPM. The pressure switch 76 similarly provides an electric pressure signal whenever the line pressure exceeds a predetermined pressure threshold, preferably 650 PSI. The presence of both signals represents a trouble-free condition within the primary hydraulic control means 24, and the electrical circuitry 48 responsive activates the sensor-responsive valve 78 against the bias spring 80 thereof. So activated, the control means 62 delivers the primary brake release pressure supply through line 72.

The manually-activated emergency descent means 64 provides for emergency descent of the elevator car 12 under predetermined conditions of operation. The descent means 64, upon activation from within the elevator car 12, provides an emergency brake release pressure supply in brake supply line 82. In this preferred embodiment, the emergency descent means 64 includes a needle valve 84 and a spring-biased button valve 86, interconnected as shown. Activation requires opening of the needle valve 84 and depression of the button valve 86.

As shown in FIG. 2, the control means 62 and descent means 64 are in fluid communication with the priority valve means 66. The priority valve means 66 selectively interconnects the control means 62 and descent means 64 to the brake means 70 via line 88.

In this preferred embodiment, the priority valve means 66 includes a spring-biased, three state valve 90. In the first or neutral state (shown in FIG. 2), the valve 90 disconnects the control means 62 and descent means 64 from line 88 and interconnects line 88 with the reservoir 28. The valve 90 is biased into the first state by springs 92, 94, having equal spring tensions of preferably 60 pounds.

The presence of the primary brake release pressure supply in line 72 overcomes the spring bias and shifts the multi-state valve 90 to the second operative state. In the second state, lines 72, 88 are interconnected, and the primary release pressure supply passes through priority valve means 66 into line 88. In this preferred embodiment, the line pressure generated by the primary release pressure supply is preferably in the range of 650–3,000 PSI.

The priority valve means 66 operates similarly in response to the emergency brake release pressure supply produced by the descent system 64 and thereby interconnects lines 82, 88. The pressure produced by the emergency brake release pressure supply in line 82 is, however, preferably in the range of 400–1,500 PSI. Thus, the valve 90 shifts to the third state, interconnecting lines 82, 88, only in the absence of the primary release pressure supply.

Termination of the primary and emergency brake release pressure supplies results in shifting of the valve 90 into the first state. Interconnection of line 88 to the reservoir 28 dumps hydraulic fluid into the reservoir 28, thereby eliminating hydraulic pressure to the brake means 70.

The emergency stop means 68 interposes the priority valve means 66 and the brake means 70, as shown. The emergency stop means 68 provides for an emergency total stop of the elevator car 12, irrespective of the operational state or conditions of the hydraulic elevator 10. That is, activation of the emergency stop means 68 immediately locks the position of the elevator car 12 with respect to the guide rail mast 14. In this preferred embodiment, the emergency stop means 68 overrides the control means 62 and descent means 64 so as to activate the brake means 70. The override is achieved by effective disconnection of the control means 62 and descent means 64 from the brake means 70 and termination of the primary or emergency brake release pressure supply.

In this preferred embodiment, the emergency stop means 68 includes a button valve 96 having two operational states, i.e., inoperative and operative. In the inoperative state, the button valve 96 interconnects line 88 to the brake means 70. The presence of the primary or emergency brake release pressure supply within line 88 will, in turn, deactivate the brake means 70 and free the elevator car 12 for movement along the guide rail mast 14.

In the operative state, the button valve 96 interconnects the brake means 70 directly to the reservoir 28, as shown. Thus, in the operative state of the emergency stop means 68, the line 88 is disconnected or blocked from the brake means 70 to provide substantially immediate activation of the brake means 70 and locking of the elevator car 12.

The brake means 70 selectively locks and releases the elevator car 12 with respect to the guide rail mast 14 in response to the primary and emergency brake release pressure supplies. In the locked and activated mode, the elevator car 12 is immovable in either direction.

The brake means 70 includes a multi-disc hydraulic pressure-released brake 98, having a rotatable shaft 100, and brake gear means 102 for interconnecting the hydraulic pressure-released brake 98 to the guide rail mast 14. In this preferred embodiment, the multi-disc hydraulic pressure-released brake 98 releases and frees the brake gear means 102 upon receipt of the primary or emergency brake release pressure supply by the brake means 70.

The hydraulic elevator 10 also includes, in this preferred embodiment, hydrualic safety-governor means, generally designated 104. The hydraulic safety-governor means 104 is operative continuously during descent of the elevator car 12 to monitor speed and, when necessary, to control or restrict the descent speed, irrespective of weight within the elevator car 12. This substantially avoids an overspeed problem.

In this preferred embodiment, the hydraulic safety-governor means 104 includes a hydraulic circuit 106 mechanically coupled to the brake means 70. This circuit 106 includes a hydraulic pump 108, mechanically coupled to the shaft 100 of the hydraulic pressure-released brake 98, flow restriction valve 110, reservoir 112, accumulator 114, check valve 116, pressure relief valve 118, and pressure reduction valve 120, interconnected as shown. The reservoir 112 is charged by the primary hydraulic control means 24. The pressure reduction valve 120 restricts charging thereof t o 1,200 PSI, and the check valve 116 substantially prohibits leakage into line 72. The accumulator 114 stores pressurized hydraulic fluid to ensure sufficient supply and further pressurizes the reservoir 112. Such pressurization provides adequate hydraulic flow within the safety-governor means 104 in cold weather. The relief valve 118 substantially avoids overpressurization due to leakage and thermal expansion.

In response to descent of the elevator car 12 and the resulting rotation of the hydraulic brake shaft 100, the hydraulic pump 108 produces a descent hydraulic flow within the circuit 106. The flow restriction valve 110 governs and restricts the descent hydraulic flow to a predetermined descent flow rate, thereby maintaining the descent speed of the elevator car 12. Preferably the predetermined descent flow rate corresponds to a maximum descent rate of 160 FPM, which is independent of cage weight or load.

As shown in FIG. 2, the manually-activated emergency descent means 64 is in fluid communication with the hydraulic circuit 106 of the safety-governor means 104 whenever the needle valve 84 is open. The emergency brake release pressure supply is thus drawn from the safety-governor means 104 by the descent means 64.

In this preferred embodiment, the flow control means 34 of the primary hydraulic control means 24 includes counterbalance valve means 122 in fluid communication with the hydraulic motor 18. The counterbalance valve means 122 substantially equalizes the line pressure about the hydraulic motor 18. The counterbalance valve means 122 includes a counterbalance valve 124 having compensating spools (not shown) therein. As line pressure to the hydraulic motor 18 drops, e.g., when the elevator car 12 stops at a landing or when a line ruptures, the compensating spools shift to restrict the flow of hydraulic fluid from the hydraulic motor 18. Full closure of the spools terminates flow and positionally stops the elevator car 12.

The counterbalance valve means 122 further includes a pilot line 126 in fluid communication with the hydraulic pump 30 via line 88. Whenever line pressure drops below a predetermined pressure threshold, preferably 650 PSI, the counterbalance valve means 122 fully closes to terminate flow and stop the hydraulic motor 18. The counterbalance valve means 122 thus operates as the primary braking mechanism. Since the counterbalance valve means 122 is in fluid communication with the brake means 70, as shown, deactivation of the hydraulic pressure-released brake 98 also deactivate and unlocks the counterbalance valve 124 to permit hydraulic flow therethrough.

A single preferred embodiment of the present invention has been described herein. It is to be understood that modifications and changes can be made without departing from the scope and spirit of the present invention as defined by the following claims.

What is claimed is:

1. A hydraulic elevator comprising, in combination:
a guide rail mast;
an elevator car mounted on said guide rail mast;
primary hydraulic control means for providing a regulated hydraulic flow having a direction and a rate, said primary hydrualic control means having a line pressure;
primary motor means, interconnected to said primary hydraulic control means and responsive to said regulated hydraulic flow, for bidirectionally driving said elevator car along said guide rail mast, said primary motor means including a hydrualic motor and motor gear means for interconnecting said hydrualic motor and said guide rail mast;
control means for monitoring said regulated hydraulic flow and for providing a primary brake release pressure supply under predetermined conditions within said primary hydraulic control means;
manually-activated emergency descent means for providing an emergency brake release pressure supply;
brake means, responsive to said primary brake release pressure supply and said emergency brake release pressure supply, for selectively locking and releasing said elevator car in relation to said guide rail mast, said brake means including a hydraulic brake and brake gear means for interconnecting said hydraulic brake and said guide rail mast;
emergency stop means for overriding said control means and said manually-activated emergency descent means so as to activate said hydraulic brake and positionally lock said elevator car; and
hydraulic safety-governor means for monitoring and controlling said elevator car during descent thereof, said hydrualic safety-governor means including a hydrulic circuit mechanically coupled to said brake means;
said manually-activated emergency descent means being in fluid communication with said hydraulic circuit so as to draw said emergency brake release pressure supply therefrom.

2. A hydraulic elevator as claimed in claim 1 wherein said primary hydraulic control means includes directional control means for setting said direction of said regulated hydraulic flow, whereby the operational direction of said primary motor means and said elevator car is controlled.

3. A hydrualic elevator as claimed in claim 2 wherein said primary hydraulic control means further includes rate control means for setting said rate of said regulated hydraulic flow, whereby the operational speed of said primary motor means and said elevator car is controlled.

4. A hydraulic elevator as claimed in claim 1 or 3 wherein said control means monitors said rate and said line pressure.

5. A hydraulic elevator as claimed in claim 1 wherein said hydraulic circuit includes hydraulic pump means, drivingly coupled to said hydraulic brake, for producing a descent hydraulic flow and descent control means for restricting said descent hydraulic flow to a predetermined descent flow rate, thereby monitoring and controlling said brake gear means and said elevator car during descent.

6. A hydraulic elevator as claimed in claim 5 further comprising priority valve means, in fluid communication with said control means and said manually-activated emergency descent means, for controllably interconnecting said control means and said manually-activated emergency descent means to said brake means.

7. A hydraulic elevator as claimed in claim 6 wherein said priority means means interconnects said control means to said brake means in response to said primary brake release pressure supply.

8. A hydraulic elevator as claimed in claim 7 wherein said priority valve means interconnects said manually-activated emergency descent means to said brake means in response to said emergency brake release pressure supply in the absence of said primary brake release pressure supply.

9. A hydraulic elevator as claimed in claim 1 or 5 further comprising priority valve means, in fluid communication with said control means and said manually-activated emergency descent means, for controllably interconnecting said control means and said manually-activated emergency descent means to said brake means.

10. A hydraulic elevator as claimed in claim 9 wherein said priority valve means interconnects said control means to said brake means in response to said primary brake release pressure supply.

11. A hydraulic elevator as claimed in claim 10 wherein said priority valve means interconnects said manually-activated emergency descent means to said brake means in response to said emergency brake release pressure supply in the absence of said primary brake release pressure supply.

* * * * *